US006269656B1

(12) United States Patent
Johnston

(10) Patent No.: US 6,269,656 B1
(45) Date of Patent: Aug. 7, 2001

(54) METHOD AND APPARATUS FOR PRODUCING LIQUIFIED NATURAL GAS

(76) Inventor: Richard P. Johnston, 641 Joe Wheeler Brown Rd., Fulton, MI (US) 38843

( * ) Notice: Subject to any disclaimer, the term of this patent is extended or adjusted under 35 U.S.C. 154(b) by 0 days.

(21) Appl. No.: 09/156,241

(22) Filed: Sep. 18, 1998

(51) Int. Cl.[7] ..... F25J 1/00
(52) U.S. Cl. ..... 62/613; 62/611
(58) Field of Search ..... 62/611, 613, 605, 62/615

(56) References Cited

U.S. PATENT DOCUMENTS

| | | | | |
|---|---|---|---|---|
| 2,209,534 | * | 7/1940 | Moore | 62/613 |
| 2,903,858 | * | 9/1959 | Bocquet | 62/613 |
| 3,383,873 | * | 5/1968 | Becker | 62/613 |
| 3,616,652 | * | 11/1971 | Engel | 62/613 |
| 3,657,898 | | 4/1972 | Ness et al. . | |
| 3,677,019 | * | 7/1972 | Olszewski | 62/613 |
| 3,735,600 | * | 5/1973 | Dowdell et al. | 62/613 |
| 3,818,714 | | 6/1974 | Etzbach et al. . | |
| 3,837,172 | | 9/1974 | Markbreiter et al. . | |
| 4,033,735 | | 7/1977 | Swenson . | |
| 4,139,019 | | 2/1979 | Bresie et al. . | |
| 4,213,476 | | 7/1980 | Bresie et al. . | |
| 4,215,753 | | 8/1980 | Champness . | |
| 4,359,871 | | 11/1982 | Strass . | |
| 4,419,114 | | 12/1983 | May et al. . | |
| 4,505,722 | | 3/1985 | Shelton, Jr. . | |
| 4,920,749 | | 5/1990 | Letarte . | |
| 4,970,867 | | 11/1990 | Herron et al. . | |
| 5,003,782 | | 4/1991 | Kucerija . | |
| 5,036,671 | | 8/1991 | Nelson et al. . | |
| 5,199,266 | | 4/1993 | Johansen . | |
| 5,231,835 | | 8/1993 | Beddome et al. . | |
| 5,287,703 | | 2/1994 | Bernhard et al. . | |
| 5,615,561 | * | 4/1997 | Houshmand et al. | 62/611 |
| 5,755,114 | | 5/1998 | Foglietta . | |
| 5,836,173 | * | 11/1998 | Lynch et al. | 62/613 |

* cited by examiner

*Primary Examiner*—William Doerrler
(74) *Attorney, Agent, or Firm*—Frost Brown Todd LLC

(57) ABSTRACT

Both a method and apparatus for producing liquified natural gas (LNG) at a well head or other source where cool high pressure natural gas is provided. The natural gas flow from the source is cleaned, if required, and is split into two portions. The first flow portion goes to a primary heat exchanger, then to a second heat exchanger or super cooler, and is thereafter throttled into a LNG tank wherein a part thereof flashes to liquid natural gas and a part thereof becomes a very cold saturated vapor to be vented from the LNG tank. This vent remainder of the first flow portion enters the super cooler as a coolant therefor. The second flow portion enters an expander where work is extracted and the temperature and pressure of the second flow portion are lowered. The cold lower pressure second portion combines with the partially warmed vent remainder of the first portion from the super cooler and passes into the primary heat exchanger as the initial coolant for the first portion. The combined warmed second portion and first portion vent remainder then pass out of the system into a low pressure receiver such as a pipeline. The combined portions are at a pressure equal to or greater than that in the receiver. In a second embodiment the supercooler is eliminated, somewhat reducing the liquid natural gas produced.

57 Claims, 3 Drawing Sheets

METHOD AND APPARATUS FOR PRODUCING LIQUIFIED NATURAL GAS

TECHNICAL FIELD

Method and apparatus for a system of producing liquified natural gas, and more particularly to such a system which is associated directly with a well head or other high pressure natural gas source and requires no external power source.

BACKGROUND ART

The present invention is based upon the discovery that a simple, efficient, open, partial conversion system for the production of liquid natural gas (LNG) can be provided if natural gas, taken directly from the well head or other source under high pressure and cleaned (if required), is immediately thereafter split into two high pressure flow portions. The first high pressure flow portion is the source of the liquid natural gas fraction, the vent remainder of the first flow portion constituting a cold saturated vapor used thereafter as a coolant for the system. The second high pressure flow portion is cooled and is used solely as a coolant for the system. The second flow portion and the remainder of the first flow portion are ultimately conducted to an appropriate receiver having a pressure lower than that of the well head or other source. Neither of the first and second flow portions is reduced in pressure to a level less than the pressure within the receiver.

Prior art workers have devised many types of partial conversion and total conversion systems for the production of liquid natural gas. This is exemplified in U.S. Pat. No. 3,735,600 wherein an open cycle is taught utilizing well head gas. In this system, however, once the well head gas has been purified, it is not immediately split into two flow portions. The arrangement of equipment components differs from that of the present invention, as do the steps performed in the reference system.

Other exemplary prior art natural gas liquification systems are taught, for example, in U.S. Pat. Nos. 3,818,714 and 4,970,867, both of which demonstrate the more complex prior art approaches.

DISCLOSURE OF THE INVENTION

According to the invention there is provided both an apparatus and a method for a system of producing liquid natural gas. A first embodiment of the system is associated directly with a well head or other source which provides a supply of high pressure natural gas. The gas flow obtained from the source is cleaned, unless the source provides natural gas clean enough to enable the formation of a liquid natural gas fraction, and thereafter is split into first and second high pressure flow portions. The first portion of the flow goes directly to a first or primary heat exchanger where it is cooled. Thereafter, the first flow portion passes through a second heat exchanger or super cooler where it is further cooled. The super cooled high pressure first flow portion is throttled into a liquid natural gas collector wherein a part of the first flow portion flashes to liquid natural gas, and the vent remainder of the first flow portion constitutes a cold saturated natural gas vapor.

The second portion of the flow is cooled in an expander by work extraction and then passes through the primary heat exchanger, serving as the cooling medium therefor. The remaining very cold, saturated gas of the first flow portion in the liquid natural gas collector is vented through the super cooler heat exchanger as the cooling medium therefor and then combines as an additional cooling medium with the second flow portion as it enters the primary heat exchanger. The warmed combined flows, having served as the cooling medium for the primary heat exchanger, are conducted therefrom to a lower pressure receiver such as a gas distribution pipeline. In the expander, the second flow portion is reduced in pressure to a level equal to or somewhat higher than that of the receiver. The remaining part of the first flow portion in the liquid natural gas tank is also reduced to a pressure equal to or somewhat greater than that of the receiver. Thus both flow portions can be introduced into the receiver.

A second embodiment of the system of the present invention is also associated directly with a well head or other source of high pressure natural gas. Following cleaning, if required, the natural gas from the source is split into first and second high pressure flow portions. The first flow portion goes directly to a primary heat exchanger where it is cooled. Thereafter, the first flow portion is throttled into a liquid natural gas collector wherein a part of the first flow portion flashes to liquid natural gas. The second portion of the flow is cooled in an expander by work extraction. The vent remainder of the first flow portion from the liquid natural gas tank is joined by the cooled second portion of the gas flow from the expander. These combined flows pass through and act as coolant for the single heat exchanger and are then introduced into an appropriate receiver.

DETAILED DESCRIPTION OF THE INVENTION

Figure 1:
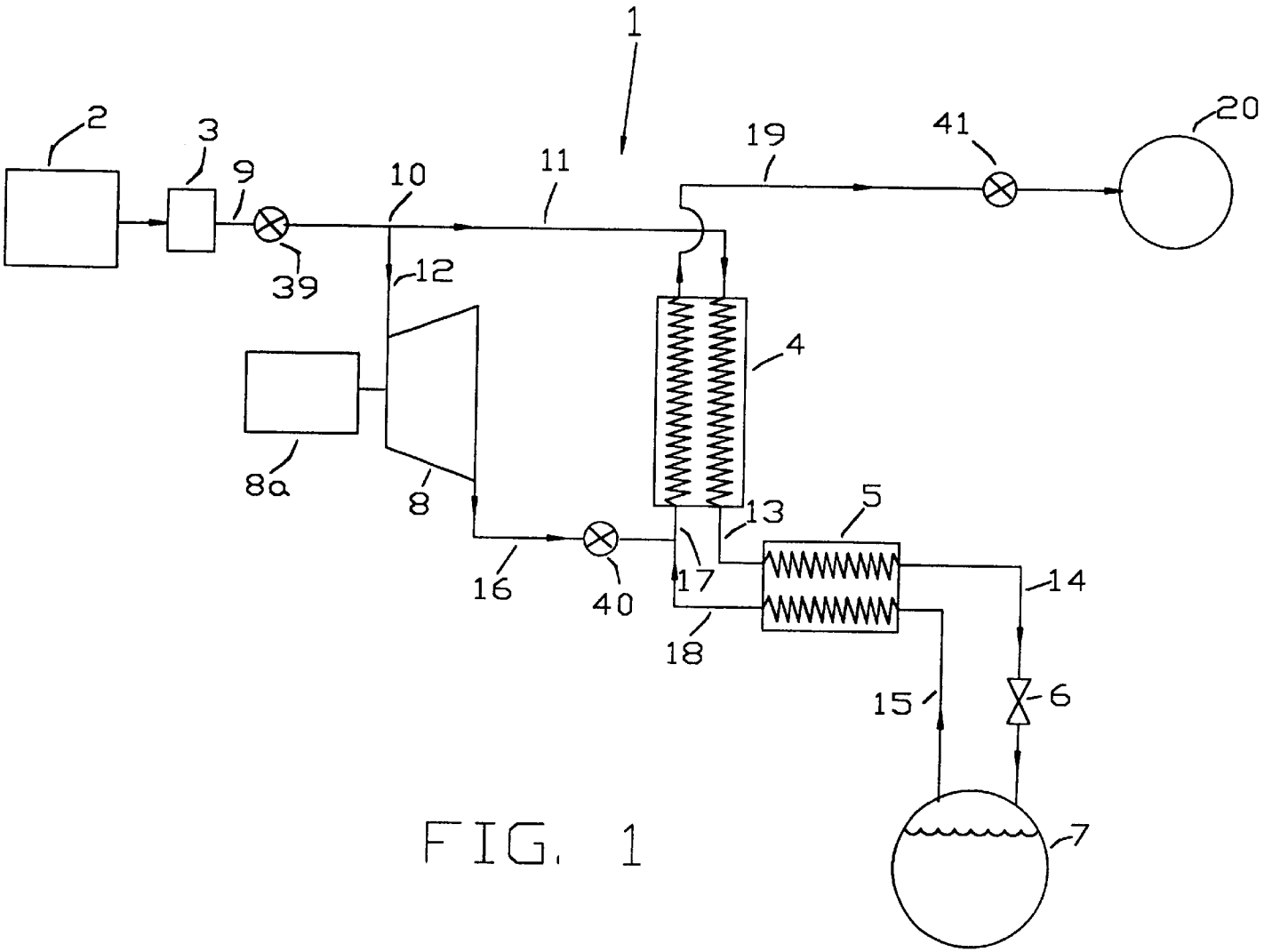
FIG. 1 is a simplified schematic representation of a first embodiment of the system of the present invention.

Reference is first made to FIG. 1, wherein a first embodiment of the invention is illustrated in diagrammatic form. The overall system is generally indicated at 1. The system comprises a gas source 2, a purifier 3, a first or primary heat exchanger 4, a second heat exchanger or super cooler 5, a restrictor (as, for example, a throttle valve 6), a liquid natural gas collector (as, for example, a tank 7), an expander 8 and interconnecting conduits to be described.

A well head or other high pressure source is diagrammatically indicated at 2 and comprises a source of high pressure, natural gas. Flow from source 2 is conducted by conduit 9 through a purifier 3 to cleanse it of water, other liquids, heavier molecules and other unwanted constituents. Such a purifier would in most instances be required if the source is a well head. If the source provides natural gas which is sufficiently free of constituents which would interfere with the formation of liquefied natural gas, the purifier 3 could be eliminated. Thereafter, the cleansed flow is conducted by conduit 9 to a point 10 where the flow is split into two portions. The split is determined by the pressure relationship between the source and the receiver, the properties of the liquid natural gas, optimization of the heat exchange process, and the thermodynamic efficiency of the components of the system. A part of the flow in conduit 9 passes through conduit 11 and will be referred to as the first flow portion. The other part of the flow in conduit 9 passes through conduit 12 and will be referred to herein as the second flow portion.

The first flow portion in conduit 11 passes through the primary heat exchanger 4 wherein it is cooled. The cooled first flow portion is conducted by conduit 13 to the second heat exchanger or super cooler 5 wherein it is further cooled. Primary heat exchanger 4 and super cooler 5 may each constitute any appropriate type of heat exchanger. Excellent results are achieved when the primary heat exchanger 4 and super cooler 5 are of the cross-counter flow type, as is well known in the art.

Figure 2:
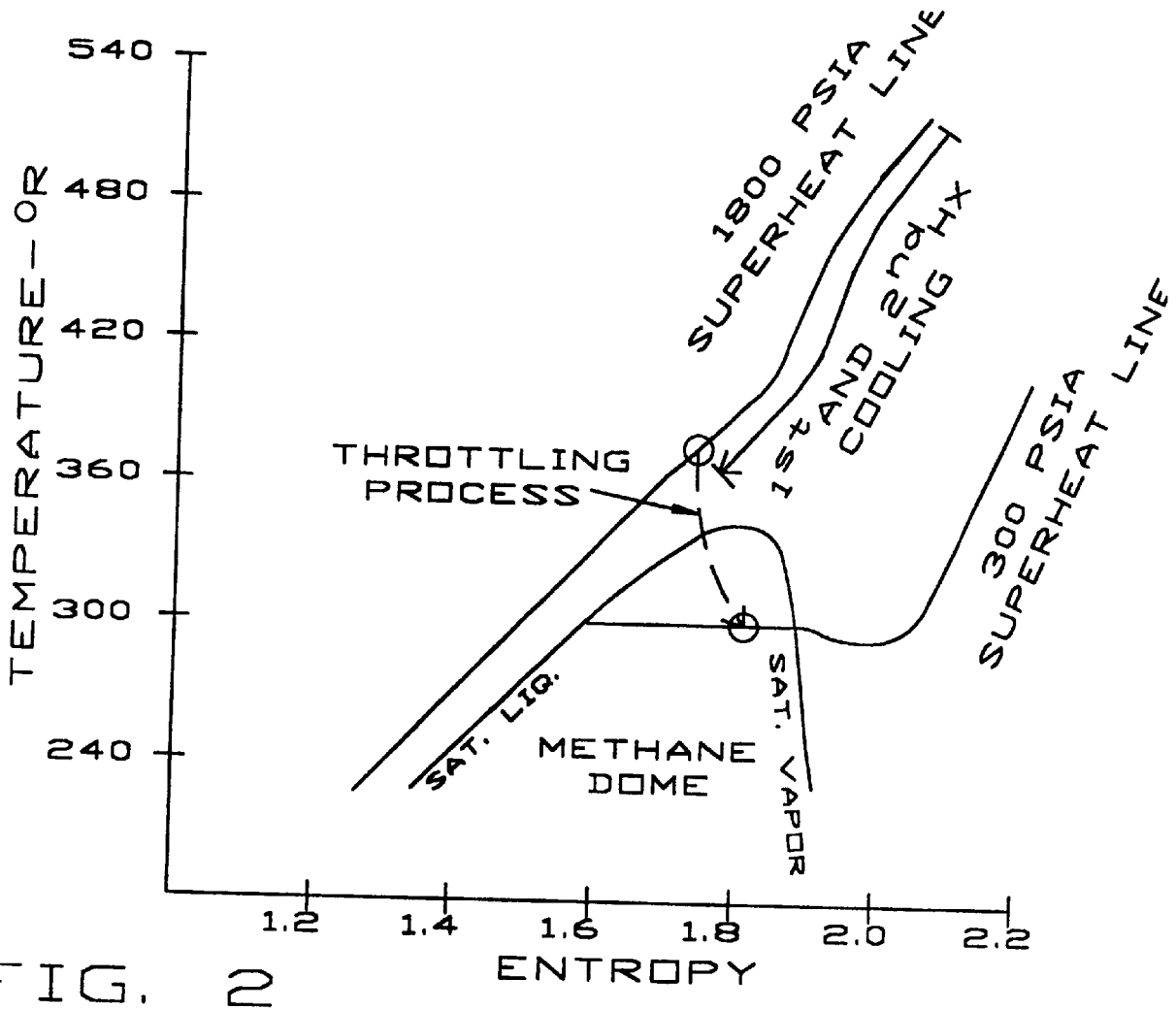
FIG. 2 is a generic methane liquefaction diagram for the process utilized by this invention.

The first flow portion, having been cooled in super cooler 5, is conducted by conduit 14 to the throttle valve 6 by which it is throttled into a lower pressure liquid natural gas tank 7. The first flow portion is throttled by throttle valve 6 to a pressure low enough to pass through the saturated liquid/vapor dome as shown in the methane liquification diagram of FIG. 2. Part of the first gas portion flashes to liquid natural gas. The unliquified part of the first flow portion constitutes a cold, saturated natural gas vapor at a pressure such that it can be vented by conduit 15 to super cooler 5 and caused to pass therethrough, serving as the cooling medium for the super cooler 5.

The second flow portion of the natural gas from source 2 passes through conduit 12 to an expander 8 where it is expanded and cooled by extracting expander work. For example, the expander 8 may be used to run a generator or the like. In FIG. 1, a generator is diagrammatically shown at 8*a*. The expander 8 may be of any appropriate type such as a positive displacement piston expander, a turbo expander, or a radial vane expander, all as are known in the art. The cooled second flow portion from expander 8 is conducted by conduit 16 to the primary heat exchanger 4. Just before it enters the primary heat exchanger 4, the second flow portion is joined by the vent remainder of the first flow portion at point 17. The vent remainder of the first flow portion is conducted from super cooler 5 to the point 17 by conduit 18. The recombined first flow portion vent remainder and second flow portion serve as the coolant for primary heat exchanger 4. Once they have passed therethrough, they are conducted by conduit 19 to a lower pressure receiver generally indicated at 20. The receiver may be any appropriate receiver such as the inlet of a gas turbine, an inlet of a chemical process, a gas distribution pipeline, a pump inlet, a burner head, or the like. For purposes of an exemplary showing, the lower pressure receiver 20 may be considered to be a distribution pipeline.

In order for the recombined first flow portion vent remainder and second flow portion in conduit 19 to pass to the lower pressure receiver or pipeline, they must be at a pressure equal to or greater than the receiver pressure. As a consequence, expander 8 cannot reduce the pressure of the second flow portion below a value equal to or greater than the pressure of receiver 20. Similarly, the first flow portion cannot be throttled to a pressure lower than the receiver pressure.

It will be understood by one skilled in the art that the amount of liquid natural gas produced is a function of the equipment efficiency, the initial well head (or other source of high pressure gas) conditions (i.e., temperature and pressure), and the like. For example, while not necessarily so limited, pressures frequently encountered at the well head will be above 1000 psia. For any significant liquid natural gas (LNG) production, the well head (or other source) supply pressure must be high enough for adequate expander work (cooling) to be achieved to cool the first portion of the gas flow ahead of throttle 6 to a suitable condition for LNG production in tank 7.

To describe the operation of system 1 of FIG. 1, exemplary but non-limiting conditions of temperature and pressure will be set forth with assumed levels of efficiency. For purposes of an exemplary showing, it will be assumed that the primary heat exchanger 4 has an effectiveness of about 0.90, the super cooler 5 has an effectiveness of about 0.90, and the expander 8 has an adiabatic efficiency of about 80 percent.

In the operation of the system of FIG. 1, it will be assumed that the natural gas at the source 2 has a pressure of 1800 psia and a temperature of 70° F. (530° R). At point 10 the natural gas stream in conduit 9 is split, 40% going into the first flow portion received in conduit 11 and 60% going into the second flow portion received in conduit 12. The first flow portion will pass through conduit 11, primary heat exchanger 4, conduit 13, super cooler 5 and conduit 14 to throttle valve 6. The first flow portion will maintain a pressure of essentially 1800 psia until it reaches throttle valve 4. The first flow portion, as it exits primary heat exchanger 4, will have a temperature of about −91° F. (369° R). Having passed through super cooler 5, the first flow portion will achieve a temperature of about −106° F. (354° R). Passing through the throttle valve 6, the first flow portion will drop to a temperature of about −160° F. (300° R) and a pressure of just above 300 psia. That part of the first flow portion which does not flash to liquid natural gas will retain a pressure of just above 300 psia through its return travel in super cooler 5 and its return travel through primary heat exchanger 4 and conduit 19 to the distribution pipeline 20. It will be assumed that the pipeline pressure is about 300 psia. It will be noted that the pressure within tank 7 was chosen to be equal to or greater than the pipeline pressure. The vent remainder of first flow portion will rise in temperature as it passes through super cooler 5 from about −160° F. (300° R) to about −99° F. (361° R).

The second flow portion, entering conduit 12, will have the well head temperature of 70° F. (530° R) and the well head pressure of 1800 psia. In the expander 8 the pressure of the second flow portion will drop to about 300 psia and the temperature will drop to about −112° F. (348° R). It will be noted, as indicated above, that the pressure drop of the second flow portion in the expander 8 is regulated so that the second flow portion passes out of the expander 8 at a pressure at least equal to or somewhat greater than the pressure in the receiver or pipeline 20. The combined first and second flow portions will exit the primary heat exchanger 4 at a temperature of about 52° F. (512° R). The receiver or pipeline will have a pressure of about 300 psia.

It will be understood that the system of FIG. 1 makes use of the Joule-Thompson refrigerator principle via the supercooler 5. Specifically, the very cold saturated vapor from tank 7 is vented back through super cooler 5 to help reduce the incoming first flow portion temperature to a sufficiently low level that it can be partially condensed directly to liquid natural gas after passing through throttle valve 6. The proposed system is greatly simplified compared to conventional liquid natural gas production systems, since the system of the present invention takes advantage of the naturally occurring high pressure natural gas at the well head or other high pressure source. The system of the present invention is not a total conversion system, but rather converts a fraction of the incoming natural gas to liquid natural gas. The remaining warmed gaseous methane passes out of the system to a lower pressure receiver such as pipeline 20. System 1 is capable of converting about 26 percent of the well head natural gas flow to liquid natural gas with about 74 percent of the well head gas passing out of the system to pipeline 19, with the assumed component efficiencies and supply pressure conditions.

The parameters of temperature, pressure, flow splits and the like, given in the example above, are exemplary only. They will change depending on the temperature and pressure of the well head or source 2, the nature of the receiver 19, the efficiency of the equipment and other related factors. To adjust the parameters to suit the circumstances and to maximize LNG production is well within the skill of the worker in the art. For example, the split of the well head flow into first and second portions will be optimized for heat transfer at different values for maximum LNG production depending on the well head or other supply conditions, and the efficiency levels of the various components of the system.

It has been determined that a system similar to embodiment 1, with the supercooler removed, is still a viable system although the liquid natural gas yield is less. The supercooler heat exchanger 5 of FIG. 1, having a Joule-Thompson Refrigerator function, constitutes a cooling economizer that improves the equipment results of embodiment 1 of FIG. 1.

Figure 3:
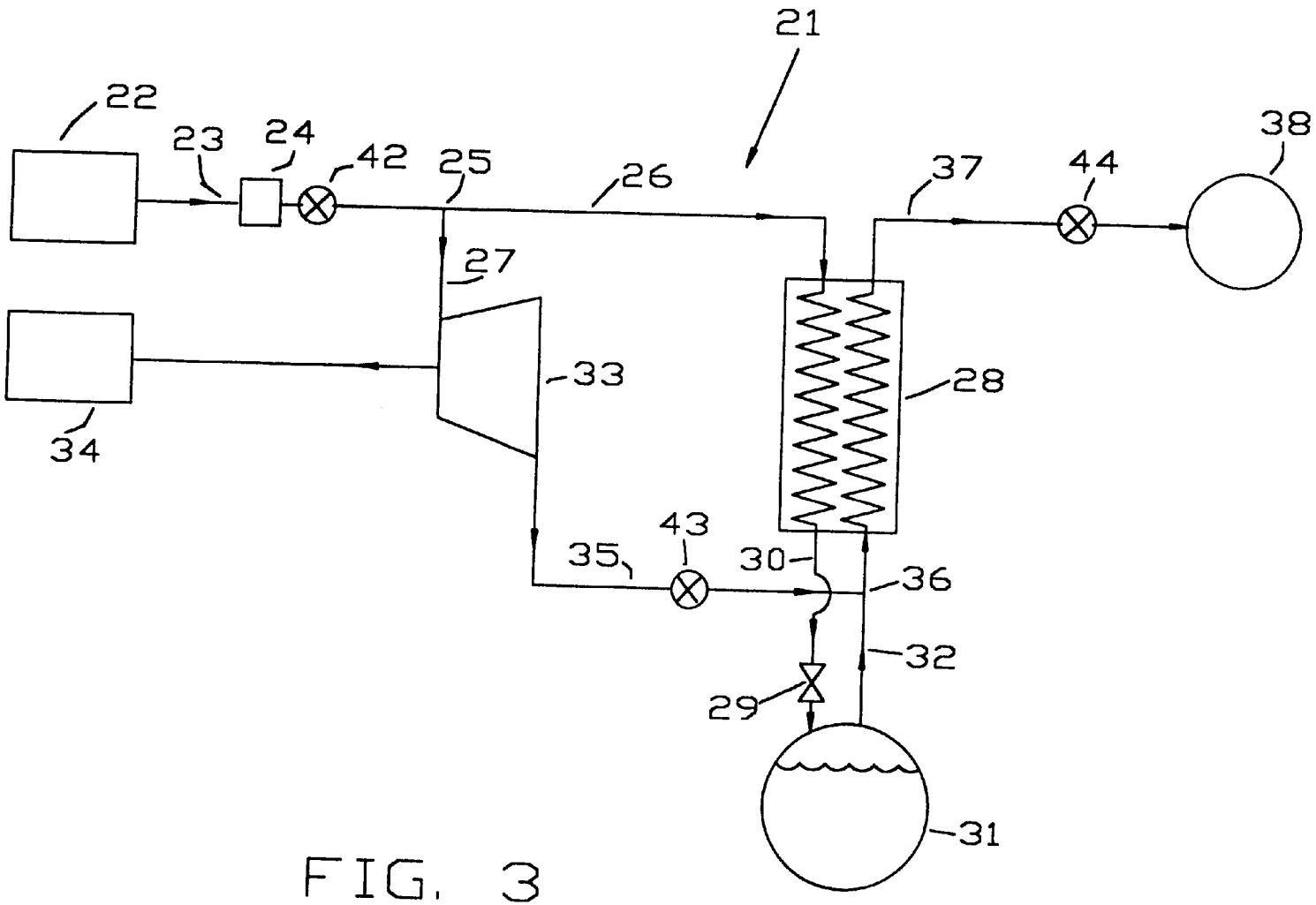
FIG. 3 is a simplified schematic representation of a second embodiment of the system of the present invention.

FIG. 3 illustrates the second embodiment of the present invention with the supercooler eliminated. In FIG. 3, this embodiment is generally indicated at 21 and includes a well head or other appropriate source of high pressure, natural gas, equivalent to source 2 of FIG. 1. The natural gas is conducted by conduit 23 to a purifier 24 equivalent to purifier 3 of FIG. 1 (if needed). The cleansed flow is conducted by conduit 23 to a point 25 where the flow is split into two portions, the first portion passing through conduit 26, the second portion passing through conduit 27. The first flow portion is directed to and passes through a single heat exchanger 28. The cooled first flow portion passes from heat exchanger 28 to a restrictor, (as, for example, a throttle valve 29), via conduit 30. The first flow portion is throttled by valve 29 into a lower pressure liquid natural gas collector (as, for example, a tank 31). The first flow portion is throttled by throttle valve 29 to a pressure low enough to pass through the saturated liquid/vapor dome (FIG. 2) with the result that part of the first gas portion flashes to liquid natural gas, the unliquified remainder of the first flow portion being vented from tank 31 via conduit 32 to heat exchanger 28. Before the vent remainder of the first flow portion is introduced into heat exchanger 28, it is mixed with an expanded and cooled second flow portion having been directed by conduit 27 to an expander 33. The expander 33 is equivalent to expander 8 and may be used to drive an appropriate element such as a generator 34 or the like. As in the case of expander 8, the expander 33 may be of any appropriate type such as a positive displacement piston expander, a turbo expander or a radial vane expander, or the like, as known in the art. The expanded and cooled gas from expander 33 is directed by conduit 35 to a point 36 where it joins conduit 32 and the vent remainder of the first flow portion from the liquid natural gas tank 31. Once this combined flow has passed through the single heat exchanger 28, it is directed by conduit 37 to an appropriate receiver 38, equivalent to receiver 20 of FIG. 1.

In this embodiment, it will again be assumed that the gas from source 22 had a temperature of 70° F. (530° R) and a pressure of 1800 psia, identical to the example of gas from source 2 of FIG. 1. The split at point 25 into first and second flow portions had to be changed to maintain an optimum cooling condition for the single heat exchanger 28. Specifically, the first flow portion entering conduit 26 constituted 40.5 percent of the source flow and the second flow portion entering conduit 27 constituted 59.5 percent of the source flow. In this instance, the single heat exchanger 28 is considered to have an effectiveness of about 0.90 and the expander is considered to have an adiabatic efficiency of about 80 percent.

The first flow portion was conducted to the single heat exchanger 28 by conduit 26. Having passed through the single heat exchanger, the first flow portion was transported by conduit 30 to throttle valve 29. In conduit 30, the first flow portion was at a temperature of −103° F. (357° R) and a pressure of 1800 psia. As the first flow portion was throttled by valve 29 into the liquid natural gas tank 31 the throttled first flow portion was at a temperature of −160° F. (300° R) and a pressure of 300 psia. The vent remainder of the first flow portion exited tank 31 by means of conduit 32 at a pressure of 300 psia and a temperature of −160° F. (300° R).

The second flow portion was conducted by conduit 27 to the expander and exited the expander at a temperature of −112° F. (348° R) and a pressure 300 psia. The cooled and expanded second flow portion was conducted by conduit 35 to point 36 wherein it entered conduit 32 and was mixed with the vent remainder of the first flow portion from the liquid natural gas tank. The mixture of first and second flow portions passed through the single heat exchanger at a temperature of −123° F. (337° R) and a pressure 300 psia. From the single heat exchanger 28, the first and second flow mixture was directed to receiver 38.

The first gas stream portion entered throttle valve 29 three degrees warmer than in embodiment 1. The combined second flow portion and vent remainder of the first flow portion from the liquid natural gas tank was one degree cooler than that of embodiment 1. Overall, the liquid natural gas production was 26 percent of the gas stream from the source in the embodiment of FIG. 1, as compared to 25.6 percent after gas stream from the source in the embodiment of FIG. 3. In other words, the embodiment of FIG. 3 was 1.5 percent less efficient than the embodiment of FIG. 1.

It is clear from the above that the presence of a supercooler heat exchanger (a Joule-Thompson Refrigerator) acting as a cooling economizer improves the equipment efficiency in the first embodiment of the present invention and is therefore the preferred embodiment. Nevertheless, the second embodiment provides an adequate producer of liquid natural gas even if the efficiency is somewhat less. In addition, it saves the cost of a second heat exchanger. As in the case of the first embodiment, the parameters of temperature, pressure, flow splits and the like in the second embodiment are exemplary only. These parameters will change depending upon temperature and pressure of the source, the nature of the receiver, the efficiency of the equipment used and other related factors.

Suitable pressures and temperatures for the processing of liquid natural gas (LNG) derive from the fact that for methane the upper critical pressure and temperature are approximately 667.06 psia and 342.99° R (−117.01° F.). The lower critical pressure and temperature are approximately 1.694 psia and 163.2° R (296.8° F.). Therefore, the LNG processing tank pressure must be below 667.06 psia and above 1.694 psia. It will be remembered that the receiver pressure must be equal to or less than the exhaust pressure being received.

As described above, the maintenance of proper flows and pressure levels throughout the embodiments of the process system of the present invention depended entirely on the existence of stable inlet and exhaust pressures and flows. This stability requirement can be alleviated to some extent by the judicious placement of inlet, exhaust and expander exhaust pressure regulators. These regulators can be used to eliminate the process variability due to uncontrolled upstream and downstream pressure fluctuations. A regulator 39 may be located just before split point 10 in FIG. 1. The regulator 40 just downstream of the expander exhaust can maintain the desired flow split between expander process heat exchangers. An additional regulator 41 can be located in conduit 19 leading to receiver 20. The restrictor 6 just upstream of LNG collector or tank 7 can be fixed or variable. If variable, it can be used to regulate process pressure drops more accurately without depending completely on feedstock flow rate. This would allow some ability to re-match the process equipment to changes in source flow and pressure and exhaust receiver pressure changes. These regulators are not needed in an ideal supply/exhaust situation, but would be most helpful to maintain near optimum matching for all the flow equipment as small changes due to wear and tear, blockage and degradation of expander and heat exchanger performance levels. In FIG. 3 regulators 42, 43 and 44, equivalent to regulators 39, 40 and 41 of FIG. 1 are shown and serve the same purpose as regulators 39,40 and 41. Once again restrictor 29 can be variable for the same reasons given for restrictor 6 of FIG. 1.

From the above it will be apparent that the added regulators are desirable to modify flow and pressure throughout the systems to maintain design levels of pressure and flow. This must be done for efficient operation in the face of variations in upstream supply and downstream exhaust conditions along with the inevitable change in system component performance, wear and tear, blockage and deposit accumulations.

When purification of the gas is required this can be accomplished in a number of ways. First of all in the embodiment of FIG. 1, purifier equipment could be located in conduit 9 (as shown) to thoroughly clean the source flow before it is split at 10. Another approach would be to locate purifier equipment in line 9 to partially purify the source flow to remove any impurities which might clog the apparatus. A second and more thorough purifier treatment can be applied to the first flow portion in conduit 11 to remove those impurities which would interfere with the formation of liquid natural gas. Alternatively, it would be possible to apply a thorough purifier treatment to the first flow portion from which the liquid natural gas is derived in conduit 11, and to subject the second flow portion to a lesser purifying treatment in line 12, primarily removing those impurities which might clog the apparatus.

In the embodiment of FIG. 3 the same purifying apparatus could be applied. The purifier 94 in conduit 23 may be used to thoroughly clean the source flow before it is split at 10. It would be within the scope of the invention to locate the purifier equipment in line 9 to partially purify the source flow to remove clogging impurities and a second more thorough purifier in conduit 11 for the first flow portion. Finally it would be possible to apply a thorough purifier for the first flow portion in conduit 26 and apply a lesser purifying treatment to the second flow portion in conduit 27 to remove clogging impurities.

Although the invention has been described in terms of natural gas, it is applicable to the liquification of other appropriate gases.

Modifications may be made in the invention without departing from the spirit of it.

What is claimed:

1. A method for converting a fraction of natural gas from a source to liquid natural gas comprising the steps of providing a source of pressurized, cool, clean natural gas, splitting said natural gas into first and second portions, causing said first portion to pass through at least a first heat exchanger to cool said first gas portion, causing said first gas portion to pass through a restriction into a liquid natural gas collector wherein a part of said first gas portion flashes to liquid natural gas, the remainder comprising a very cold saturated natural gas, venting said remainder through said at least first heat exchanger to serve as a cooling medium therefor, directing said second portion of said cleansed natural gas to an expander, expanding said second portion by extracting expander work, combining said cooled and expanded second portion with said vent remainder prior to passage thereof through said at least first heat exchanger, thereafter conducting said combined vent remainder of said first gas portion and said second gas portion to a receiver, and assuring that said combined vent remainder of said first gas portion and said second gas portion are at a pressure equal or greater than the pressure in said receiver.

2. The method claimed in claim 1 including the steps of providing a second heat exchanger to serve as a supercooler, locating said second heat exchanger between said first heat exchanger and said restriction, conducting said first natural gas portion from said first heat exchanger to said second heat exchanger and from said second heat exchanger to said restriction, conducting said vent remainder of said first gas portion as a cooling medium through said second heat exchanger, thereafter combining said vent remainder with said second gas portion from said expander, directing said combined vent remainder and second gas portion through said first heat exchanger as a cooling medium therefor, conducting said combined second gas portion and said vent remainder of said first gas portion to a receiver, and assuring that said combined second gas portion and vent remainder and said first gas portion are at a pressure equal to or greater than the pressure in said receiver.

3. The method claimed in claim 1 including the step of determining the split of said natural gas from said source by the pressure relationship between said source and said receiver, by the properties of the liquid natural gas, by optimization of the heat exchange process and by the thermodynamic efficiency of said at least first heat exchanger and said expander.

4. The method claimed in claim 1 including the steps of conveying said natural gas directly from said source to a purifier, removing unwanted constituents therefrom and thereafter splitting said purified natural gas into said first and second flow portions.

5. The method claimed in claim 1 wherein said restriction is a throttle valve.

6. The method claimed in claim 1 wherein said collector is a liquid natural gas tank.

7. The method claimed in claim 1 wherein said at least first heat exchanger is of the cross-counter flow type.

8. The method claimed in claim 1 wherein said expander comprises a positive displacement piston expander, a turbo expander, or a radial vane expander.

9. The method claimed in claim 1 including the step of reducing the pressure of said second flow portion in said expander to a level equal to or greater than the pressure in said receiver.

10. The method claimed in claim 1 including the step of reducing the pressure of said first portion by said restriction to a value equal to or greater than the pressure in said receiver.

11. The method claimed in claim 1 wherein said receiver is a pipeline.

12. The method claimed in claim 1 wherein said receiver comprises a gas pipeline, the inlet of a gas turbine, or the inlet of a chemical process, a pump inlet, or a burner head.

13. The method claimed in claim 1 wherein said source of said natural gas comprises a well head.

14. The method claimed in claim 2 including the step of determining the split of said natural gas from said source by the pressure relationship between said source and said receiver, by the properties of the liquid natural gas, by optimization of the heat exchange process and by the thermodynamic efficiency of said first and second heat exchangers and said expander.

15. The method claimed in claim 2 including the steps of conveying said natural gas directly from said source to a purifier, removing unwanted constituents therefrom and thereafter splitting said purified natural gas into said first and second flow portions.

16. The method claimed in claim 2 wherein said restriction is a throttle valve.

17. The method claimed in claim 2 wherein said collector is a liquid natural gas tank.

18. The method claimed in claim 2 wherein said first and second heat exchangers are of the cross-counter flow type.

19. The method claimed in claim 2 wherein said expander comprises a positive displacement piston expander, a turbo expander, or a radial vane expander.

20. The method claimed in claim 2 including the step of reducing the pressure of said second flow portion in said expander to a level equal to or greater than the pressure in said receiver.

21. The method claimed in claim 2 including the step of reducing the pressure of said first portion by said restriction to a value equal to or greater than the pressure in said receiver.

22. The method claimed in claim 2 wherein said receiver is a pipeline.

23. The method claimed in claim 2 wherein said receiver comprises a gas pipeline, the inlet of a gas turbine, or the inlet of a chemical process, a pump inlet or a burner head.

24. The method claimed in claim 2 wherein said source of said natural gas comprises a well head.

25. An apparatus for converting a fraction of the natural gas from a source thereof to liquid natural gas, said apparatus comprising a source of pressurized, cool, clean natural gas, said source being connected to a point where said natural gas from said source is split into first and second portions, at least one heat exchanger, said first gas portion being connected to said at least one heat exchanger, a restriction, said at least one heat exchanger being operatively connected to said restriction, a liquid natural gas collector, said collector being connected to said restriction whereby said first portion of said natural gas passes through said at least one heat exchanger and is throttled into said collector wherein it is partially converted to liquid natural gas, the remainder comprising a very cold saturated natural gas vapor, said collector being connected by a conduit to said at least one heat exchanger whereby to vent said vapor through said at least one heat exchanger as a cooling medium therefor, an expander, a conduit for directing said second gas portion to said expander for expansion and cooling, a conduit from said expander being connected to said conduit from said collector to said at least one heat exchanger whereby to combine said cooled and expanded second gas portion with said vented remainder of said first gas portion before entry into said at least one heat exchanger, a receiver, a conduit from said at least one heat exchanger to said receiver to convey said combination of said cooled and expanded second gas portion and said vented remainder of said first gas portion from said at least one heat exchanger to said receiver.

26. The apparatus claimed in claim 25 wherein said at least one heat exchanger comprises a first heat exchanger, a second heat exchanger comprising a super cooler, said first heat exchanger being connected to said second heat exchanger and said second heat exchanger being connected to said restriction and thereafter to said liquid natural gas collector, whereby said first gas portion can pass through both heat exchangers and said restriction to partially flash in said collector to liquid natural gas with a gaseous remainder, said collector being connected to said second heat exchanger whereby to vent said remainder of said first gas portion in said collector through said second heat exchanger as a cooling medium therefor, a conduit between said first and second heat exchangers for the passage of said remainder of said first gas portion from said second heat exchanger to said first heat exchanger, said conduit from expander being connected to said conduit from said second heat exchanger to said first heat exchanger whereby to combine said expanded and cooled second gas portion with said first gas portion remainder from said second heat exchanger to form a cooling medium for said first heat exchanger, a conduit from said first heat exchanger to said receiver whereby to convey said second gas portion and said remainder of said first gas portion to said receiver.

27. The apparatus claimed in claim 25 including the steps of conveying said natural gas directly from said source to a purifier, removing water, other liquids, heavier molecules and other unwanted constituents therefrom and thereafter splitting said cleansed natural gas into said first and second flow portions.

28. The apparatus claimed in claim 25 wherein said restriction is a throttle valve.

29. The apparatus claimed in claim 25 wherein said collector is a liquid natural gas tank.

30. The apparatus claimed in claim 25 wherein said at least one heat exchanger is of the cross-counter flow type.

31. The apparatus claimed in claim 25 wherein said expander comprises a positive displacement piston expander, a turbo expander, or a radial vane expander.

32. The apparatus claimed in claim 25 wherein said receiver is a pipeline.

33. The apparatus claimed in claim 25 wherein said receiver comprises a pipeline, the inlet of a gas turbine, or the inlet of a chemical process, a pump inlet or a burner head.

34. The apparatus claimed in claim 25 wherein said source of natural gas comprises a well head.

35. The apparatus claimed in claim 26 including the steps of conveying said natural gas directly from said source to a purifier, removing water, other liquids, heavier molecules and other unwanted constituents therefrom and thereafter splitting said cleansed natural gas into said first and second flow portions.

36. The apparatus claimed in claim 26 wherein said restriction is a throttle valve.

37. The apparatus claimed in claim 26 wherein said collector is a liquid natural gas tank.

38. The apparatus claimed in claim 26 wherein said first and second heat exchangers are of the cross-counter flow type.

39. The apparatus claimed in claim 26 wherein said expander comprises a positive displacement piston expander, a turbo expander, or a radial vane expander.

40. The apparatus claimed in claim 26 wherein said receiver is a pipeline.

41. The apparatus claimed in claim 26 wherein said receiver comprises a pipeline, the inlet of a gas turbine, or the inlet of a chemical process, a pump inlet or a burner head.

42. The apparatus claimed in claim 26 wherein said source of natural gas comprises a well head.

43. The method claimed in claim 1 including the steps of modifying flow and pressure at various points in said method to maintain design levels of pressure and flow.

44. The method claimed in claim 2 including the steps of modifying flow and pressure at various points in said method to maintain design levels of pressure and flow.

45. The apparatus claimed in claim 25 including a number of regulators added to said apparatus to regulate and modify flow and pressure at various points in said apparatus to maintain design levels of pressure and flow.

46. The apparatus claimed in claim 26 including a number of regulators added to said apparatus to regulate and modify flow and pressure at various points in said apparatus to maintain design levels of pressure and flow.

47. A method for converting a fraction of natural gas from a source to liquid natural gas, comprising the steps of:

a. providing a flow of pressurized natural gas having an initial pressure;

b. passing a first portion of said flow through at least a first heat exchanger to cool said first portion of said flow;

c. reducing the pressure of said first portion of said flow thereby flashing a first part of said first portion of said flow to liquid natural gas, leaving a second part of said first portion of said flow which comprises a saturated natural gas;

d. reducing the pressure of a second portion of said flow by passing said second portion through an expander, thereby cooling said second portion of said flow;

e. passing said second portion of said flow and said second part of said first portion of said flow through said at least a first heat exchanger to serve as a cooling medium therefor.

48. The method claimed in claim 47 comprising the step of combining said second portion of said flow with said second part of said first portion of said flow prior to the step of passing said second portion of said flow and second part of said first portion of said flow through said at least a first heat exchanger.

49. The method claimed in claim 47 including the steps of:

a. passing said first portion of said flow through at least a second heat exchanger after said first portion of said flow has passed through said at least a first heat exchanger, prior to the step of reducing the pressure of said first portion of said flow;

b. passing said second part of said first portion of said flow through said at least a second heat exchanger prior to the step of passing said second portion of said flow through said at least a first heat exchanger.

50. The method claimed in claim 49 comprising the step of combining said second portion of said flow with said second part of said first portion of said flow prior to the step of passing said second portion of said flow and second part of said first portion of said flow through said at least a first heat exchanger.

51. The method claimed in claim 47, 48, 49 or 50 including the step of determining respective flow rates of said first and second portions of said flow a. by the relationship between said initial pressure of said flow and the respective pressures of said second part of said first portion of said flow and of said second portion of said flow after the step of passing said second portion through said at least a first heat exchanger, b. by the properties of the liquid natural gas, c. by optimization of the heat exchange process, and d. by the thermodynamic efficiency of said at least a first heat exchanger and of said step of passing said second portion of said flow through said expander.

52. The method claimed in claim 47, 48, 49 or 50 including the step of removing unwanted constituents from said flow of pressurized natural gas.

53. The method claimed in claim 47, 48, 49 or 50 wherein the step of reducing the pressure of said first portion of said flow includes passing said first portion of said flow through a throttle valve.

54. The method claimed in claim 47, 48, 49 or 50 wherein said at least a first heat exchanger is of the cross-counter flow type.

55. The method claimed in claim 47, 48, 49 or 50 wherein said expander comprises a positive displacement piston expander, a turbo expander, or a radial vane expander.

56. The method claimed in claim 47, 48, 49 or 50 wherein said step of reducing the pressure of said second portion of said flow includes reducing the pressure of said second portion of said flow to a pressure equal to or greater than the pressure of said second part of said first portion of said flow.

57. The method claimed in claim 47, 48, 49 or 50 wherein said flow of pressurized natural gas comes from a well head.

* * * * *